US007736722B2

(12) United States Patent
Schmitt

(10) Patent No.: US 7,736,722 B2
(45) **Date of Patent: *Jun. 15, 2010**

(54) WAFFLED WOOD CORE SKATEBOARD

(76) Inventor: Paul G. Schmitt, 1351 Logan Ave., Costa Mesa, CA (US) 92626

( * ) Notice: Subject to any disclaimer, the term of this patent is extended or adjusted under 35 U.S.C. 154(b) by 663 days.

This patent is subject to a terminal disclaimer.

(21) Appl. No.: 11/029,203

(22) Filed: Dec. 31, 2004

(65) Prior Publication Data

US 2005/0109248 A1 May 26, 2005

Related U.S. Application Data

(62) Division of application No. 10/431,850, filed on May 7, 2003.

(51) Int. Cl.

| | |
|---|---|
| ***B32B 3/00*** | (2006.01) |
| ***B32B 3/12*** | (2006.01) |
| ***B62M 1/00*** | (2010.01) |
| ***A63C 5/14*** | (2006.01) |

(52) U.S. Cl. ..... 428/172; 428/178; 428/188; 280/87.042; 280/610; 280/841

(58) Field of Classification Search ..... 428/167, 428/172, 537.1, 178, 188; 280/87.01, 87.021, 280/87.041, 87.042, 609, 610, 841
See application file for complete search history.

(56) References Cited

U.S. PATENT DOCUMENTS

| | | | | |
|---|---|---|---|---|
| 837,661 | A * | 12/1906 | Bolton | 52/783.1 |
| 2,354,725 | A * | 8/1944 | Weyerhaeuser | 428/76 |
| 3,148,392 | A | 9/1964 | Bennet | |
| 3,369,821 | A * | 2/1968 | Weber | 280/610 |
| 3,861,699 | A | 1/1975 | Molnar | |
| 4,084,996 | A | 4/1978 | Wheeler | |
| 4,295,656 | A * | 10/1981 | Moore | 280/87.042 |
| 4,429,012 | A * | 1/1984 | Danko | 428/12 |
| 4,816,103 | A | 3/1989 | Ernest | |
| 5,109,898 | A * | 5/1992 | Schacht | 144/350 |
| 5,921,564 | A * | 7/1999 | Olson | 280/14.21 |
| 6,182,986 | B1 | 2/2001 | Smith | |
| 6,460,868 | B2 | 10/2002 | Mardrid | |
| 2004/0100052 | A1 | 5/2004 | Chou | |
| 2004/0222609 | A1 | 11/2004 | Schmitt | |
| 2005/0115470 | A1 | 6/2005 | Schmitt | |
| 2005/0115471 | A1 | 6/2005 | Schmitt | |

* cited by examiner

*Primary Examiner*—Donald Loney
(74) *Attorney, Agent, or Firm*—Charles C. H. Wu; Wu & Cheung, LLP

(57) ABSTRACT

A skateboard deck comprises a top and bottom wood portion, each wood portion having at least one layer of wood. The skateboard deck further comprises a wood core positioned in between the top and bottom wood portions. The wood core has first and second opposed surfaces, at least one of the opposed surfaces having longitudinal grooves forming hollow areas in conjunction with the top and bottom wood portions. Each of the top and bottom wood portions further comprise a crossband layer having grain perpendicular in direction to the longitudinal grooves, each crossband layer being in contact with the wood core.

5 Claims, 2 Drawing Sheets

WAFFLED WOOD CORE SKATEBOARD

This application is a divisional of co-pending application Ser. No. 10/431,850, filed May 7, 2003.

BACKGROUND OF THE INVENTION

1. Field of the Invention

The invention relates in general to skateboard decks. More particularly, this invention relates to a skateboard deck with a waffled wood core for added mass, increased strength and lighter weight.

2. Description of the Related Art

Skateboarding has maintained its popularity as a recreational sport for numerous years. Skateboards typically consist of a deck with two surfaces. On the top surface, the skateboarder stands on and maneuvers the board. The bottom surface attaches to trucks and wheels to support the deck and allow for motion.

There is an ever-increasing demand for high-performance skateboard decks. An important consideration for high-performance is the development of decks with increased strength and reduced weight. Stronger and lighter decks allow for more aggressive maneuvers and increased responsiveness. Another consideration is manufacturing costs. It is desirable to contain the cost for manufacturing new deck designs. Thus, there is a need for skateboard decks with added mass, increased strength, increased responsiveness, decreased weight and contained manufacturing costs.

In U.S. Pat. No. 5,921,564, Olson discloses a snowboard comprising a flexible core element enveloped by a covering of resin impregnated fiberglass wherein the bottom surface of the core includes a plurality of parallel grooves running the longitudinal direction of the board such that in conjunction with resin impregnated fiberglass form a series of parallel integral hollow beam members increasing the strength of the board while simultaneously reducing the overall weight.

Instead of a core with grooves on its bottom surface only, the subject invention comprises a core with longitudinal ridges on the top, bottom or both surfaces. Forming ridges on both sides of the core substantially decreases the core weight. The longitudinal ridges also retain strength.

In addition, while Olson envelops a snowboard core with resin, the subject invention positions a skateboard core in between two wood portions. Wood is the preferred material for skateboard decks. The strength and impact resistance of wood are conducive to the aggressive and intricate maneuvers skateboarders perform.

In U.S. Pat. No. 6,460,868, Madrid discloses a corrugated skateboard deck and method of corrugating skateboard decks in the skateboard deck manufacturing process. The corrugated skateboard deck has elongated corrugations embossed into at least one of its top and bottom surfaces and generally extending between first and second ends of the skateboard deck. The elongated corrugations are made up of ridges and grooves that are pressure-formed in a method of corrugating the surfaces of skateboard decks. This method utilizes a high-density corrugated template to emboss corrugations under high pressures.

Instead of corrugating a top or bottom surface of the deck, the subject invention forms longitudinal grooves on a core positioned in between two wood portions. Positioning the core in between solid layers of wood reduces weight and increases board strength without exposing the grooves on an outside surface of the skateboard deck.

In addition, while Madrid forms the corrugations by pressure molding the skateboard deck, the subject invention forms grooves by either molding or routing the wood core. By using a router, the subject invention can mill the surface of the wood core to a desired shape and thickness.

SUMMARY OF THE INVENTION

Accordingly, one object of the present invention is to provide a skateboard deck with increased mass, increased strength, lighter weight and increased responsiveness.

A second object of the invention is to provide a skateboard deck with contained manufacturing costs.

To achieve these and other advantages and in accordance with the purpose of the invention, as embodied and broadly described herein, the invention provides a skateboard deck comprising a top and bottom wood portion, each wood portion having at least one layer of wood. The skateboard deck further comprises a wood core positioned in between the top and bottom wood portions. The wood core has first and second opposed surfaces, at least one of the opposed surfaces having longitudinal grooves forming hollow areas in conjunction with the top and bottom wood portions. Each of the top and bottom wood portions further comprise a crossband layer having grain perpendicular in direction to the longitudinal grooves, each crossband layer being in contact with the wood core.

DESCRIPTION OF THE PREFERRED EMBODIMENTS

Before proceeding with a description of the apparatus and method of the present invention, a summary of crossband layers, which may be helpful in understanding the disclosed embodiment, is provided.

A crossband layer is a layer of wood having grain perpendicular in direction compared to the length of wood. The perpendicular direction of the grain in a crossband layer, as opposed to the longitudinal layers, provides structure to the wood.

Figure 1:
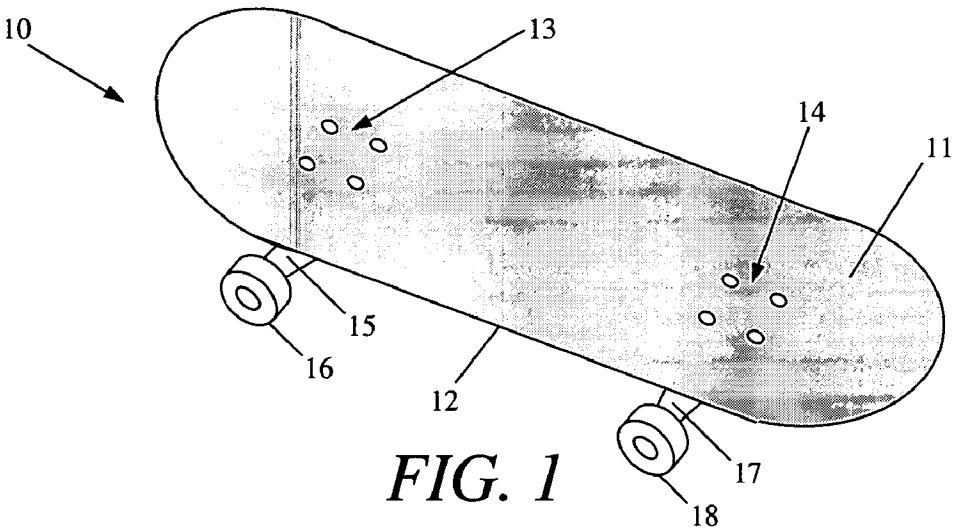
FIG. 1 is a perspective view of a typical skateboard as generally seen from the top.

Referring now to FIG. 1, a perspective view of a typical skateboard 10 as generally seen from the top is shown. The skateboard 10 includes a top surface 11 and a bottom surface 12. A pair of trucks 15, 17 mount to the bottom surface 12 at mounting holes 13, 14. Each pair of trucks 15, 17 has a pair of wheels 16, 18 attached to the end portion of trucks 15, 17.

Figure 2:
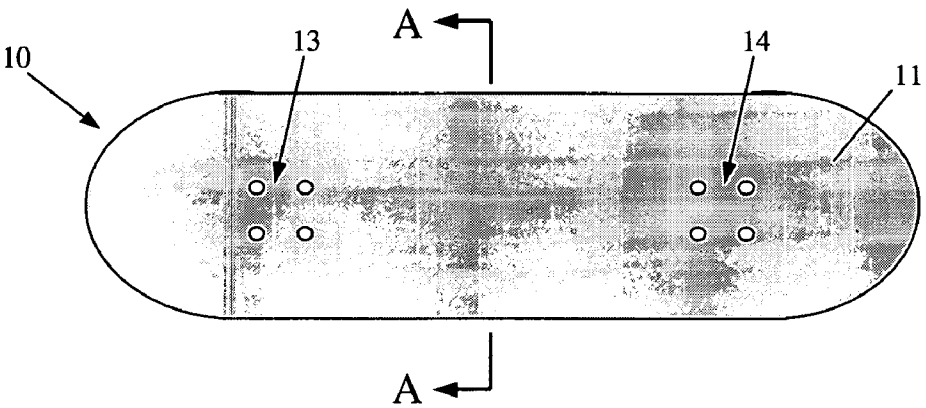
FIG. 2 is a top view of a typical skateboard deck.

As seen in FIG. 2, a top view of a typical skateboard deck 10 is shown. Mounting holes 13, 14 are visible from top surface 11.

Figure 3:
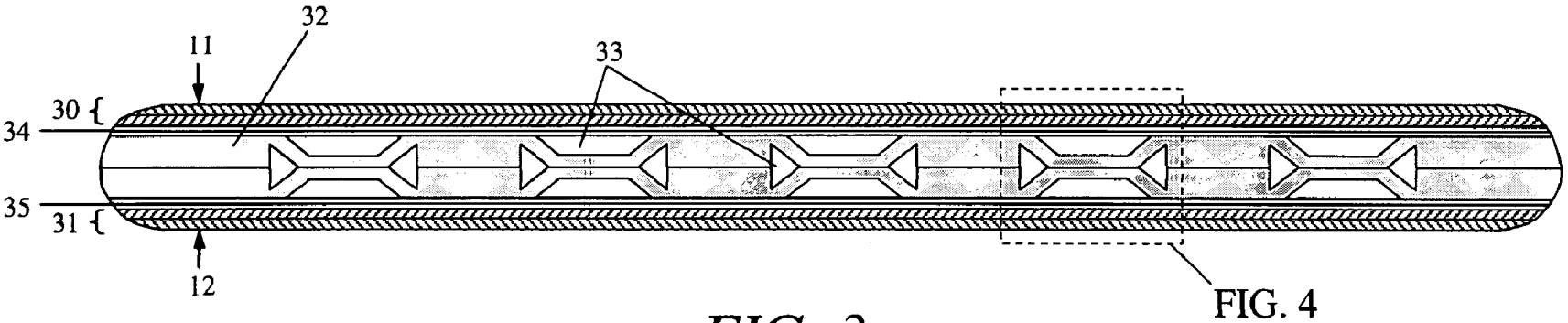
FIG. 3 is a cross-sectional view taken along the line of A-A of FIG. 2, depicting a first preferred embodiment of the invention.

With reference to FIG. 3, a cross-sectional view taken along the line of A-A of FIG. 2, depicting a first preferred embodiment of the invention is shown. Skateboard deck 10 is formed with a wood core 32 positioned in between and in direct contact with a top crossband layer 34 and a bottom crossband layer 35. The grain of crossband layers 34, 35 are perpendicular to the longitudinal direction of grooves 33 of wood core 32.

Still referring to FIG. 3, wood core 32 and crossband layers 34, 35 are further positioned in between a top wood portion 30 and bottom wood portion 31. Top wood portion 30 and bottom wood portion 31 may be formed with one or more plies of wood bonded together. In this embodiment, two plies of wood form top wood portion 30 and two plies of wood form bottom wood portion 31.

Still referring to FIG. 3, wood core 32 has parallel grooves 33 running in a longitudinal direction, forming air spaces when combined with top crossband layer 34 and bottom crossband layer 35. The grain of crossband layers 34, 35 are perpendicular in direction to parallel grooves 33, thus creating I-beams with wood core 32. This maintains the structural integrity and balance of skateboard deck 10.

Still referring to FIG. 3, grooves 33 of wood core 32 are formed using a router and glue process. Use of a router allows for continuous thickness of wood core 32. The router forms initial rectangular beams in wood core 32. After being routed, moist glue is applied to wood core 32. The moist glue softens and bends the initial rectangular edges of wood core 32, reshaping grooves 33. The moist glue then dries to fix the position of wood core 32.

Figure 4:
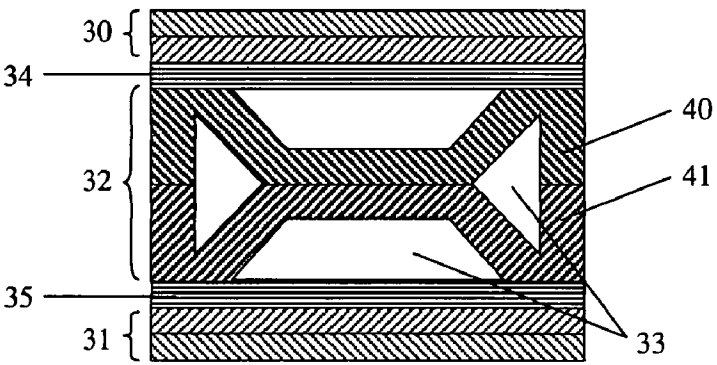
FIG. 4 is an enlarged cross-sectional view taken at (FIG. 4) in FIG. 3.

With reference to FIG. 4, an enlarged cross-sectional view taken at (FIG. 4) in FIG. 3 is shown. Two plies of wood 40, 41 are bonded to create wood core 32. Parallel grooves 33 are shaped on both the top surface and bottom surface of wood core 32. Grooves 33 are shaped in the desired manner using the routing and glue process described above. By creating grooves 33 on wood core 32, skateboard deck 10 is thicker and has more structural mass. The added structural mass increases the strength of skateboard deck 10, while the air in wood core 32 makes skateboard deck 10 lighter.

Other embodiments of the invention will appear to those skilled in the art from consideration of the specification and practice of the invention disclosed herein. For example, while the subject invention has been described as applicable to a top and bottom wood layer, other raw materials such as fiberglass, plastic or resinated paper may be employed. In addition, the longitudinal grooves can run in a substantially similar direction as opposed to being parallel. It is intended that the specification and examples to be considered as exemplary only, with a true scope and spirit of the invention being indicated by the following claims.

What is claimed is:

1. A skateboard deck comprising:

a top reinforcement layer;

a bottom reinforcement layer;

a wood core positioned in between the top and bottom reinforcement layers, the wood core having first and second opposed surfaces, each one of the opposed surfaces having longitudinal grooves forming hollow areas in conjunction with the top and bottom reinforcement layers;

wherein a router is used to give the wood core, specifically the aforementioned hollow areas, the following characteristics:

(a) trapezoidal hollow areas that are spaced at intervals along the top and bottom portions of the wood core, respectively, separated by solid portions of the wood core in between; and (b) triangular hollow areas that are spaced at intervals along the center portion of the wood core, separated by solid portions of the wood core in between.

2. The skateboard deck according to claim 1 wherein the longitudinal grooves are parallel to each other.

3. The skateboard deck according to claim 1 wherein the longitudinal grooves run in a substantially similar direction.

4. The skateboard deck according to claim 1 wherein each of the top and bottom reinforcement layers is a material selected from the group consisting of fiberglass, plastic and resinated paper.

5. The skateboard deck according to claim 1 wherein the wood core comprises two layers of wood bonded together.

* * * * *